United States Patent [19]

Chellis et al.

[11] Patent Number: 4,543,793

[45] Date of Patent: Oct. 1, 1985

[54] ELECTRONIC CONTROL OF CRYOGENIC REFRIGERATORS

[75] Inventors: Fred F. Chellis, Concord; Samuel J. Moschetto, N. Andover, both of Mass.

[73] Assignee: Helix Technology Corporation, Waltham, Mass.

[21] Appl. No.: 589,391

[22] Filed: Mar. 15, 1984

Related U.S. Application Data

[63] Continuation of Ser. No. 528,235, Aug. 31, 1983, abandoned, which is a continuation of Ser. No. 351,524, Feb. 23, 1982, abandoned.

[51] Int. Cl.[4] ..... F25B 9/00

[52] U.S. Cl. ..... 62/6; 60/520; 62/226; 62/228.1

[58] Field of Search ..... 62/6, 226, 228; 60/517, 60/520

[56] References Cited

U.S. PATENT DOCUMENTS

| | | | |
|---|---|---|---|
| 3,188,821 | 6/1965 | Chellis | 62/6 |
| 3,220,201 | 11/1965 | Heuchling et al. | 62/3 |
| 3,552,120 | 1/1971 | Beale | 60/24 |
| 3,733,837 | 5/1973 | Lobb | 62/6 |
| 3,774,405 | 11/1973 | Leo | 62/6 |
| 3,913,339 | 10/1975 | Berry | 62/6 |
| 3,921,400 | 11/1975 | Pitcher | 60/517 |
| 3,986,338 | 10/1976 | Prost et al. | 62/6 |
| 3,991,586 | 11/1976 | Acord | 62/6 |
| 4,060,996 | 12/1977 | Hanson | 62/6 |
| 4,361,011 | 11/1982 | Callender et al. | 62/3 |
| 4,389,849 | 6/1983 | Gasser et al. | 62/6 |
| 4,397,155 | 8/1983 | Davey | 62/6 |
| 4,417,448 | 11/1983 | Horn et al. | 62/6 |

OTHER PUBLICATIONS

Johnson, R. W., S. C. Collins and J. L. Smith, Jr., "Hydraulically Operated Two-Phase Helium Expansion Engine", *Advances in Cryogenic Engineering*, vol. 16, pp. 171–177.

Kneuer, R., K. Peterson and A. Stephan, "Automatic Multi-Range Helium-Liquefaction Plant Produced by Linde AG", *Linde Reports On Science and Technology*, vol. 30, 1979, pp. 97–100.

Patton, G., G. Green, K. Dunn and V. Dilling, "Hydraulically Controlled Helium Expansion Engine", *Advnaces in Cryogenic Engineering*, vol. 27, pp. 641–648.

*Primary Examiner*—Ronald C. Capossela

*Attorney, Agent, or Firm*—Hamilton, Brook, Smith & Reynolds

[57] ABSTRACT

In a cryogenics refrigerator having a piston or piston-like displacer reciprocating in a cylinder, the position of the piston or displacer, the temperature at the cold end of the cylinder and/or a refrigeration gas pressure wave are monitored to provide one or more feedback signals. Valves or a linear motor drive are controlled through electronic control circuitry which responds to the feedback signals. A displacer may be driven by pressure differentials on a drive piston or by an electric motor. The preferred elements provide feedback throughout the refrigeration cycle and include a linear variable displacement transformer and an encoder disc. Preferably, the control circuitry is in the form of a programmable digital processor.

21 Claims, 9 Drawing Figures

ELECTRONIC CONTROL OF CRYOGENIC REFRIGERATORS

RELATED APPLICATION

This is a continuation application to U.S. patent application Ser. No. 528,235, filed Aug. 31, 1983, now abandoned, which is a continuation of Ser. No. 351,524, filed Feb. 23, 1982, now abandoned.

DESCRIPTION

1. Technical Field

This invention relates to cryogenic refrigerators, or cryocoolers, having pistons or displacers which reciprocate in cylinders. Such refrigerators include Gifford-McMahon refrigerators and expansion engines.

2. Background Art

In various types of cryogenic refrigerators, a working fluid such as helium is introduced into a cylinder, and the fluid is expanded at one end of a piston to cool the cylinder. (As used herein, the term "piston" includes piston-like displacers). For example, in Gifford-McMahon type refrigerators high pressure working fluid may be valved into the warm end of the cylinder. Then the fluid is passed through a regenerator by movement of a displacer-type piston. The fluid which has been cooled in the regenerator is then expanded at the cold end of the displacer. The displacer movement may be controlled by either fluid pressure differentials or by a mechanical drive.

In the past, the valve timing in Gifford-McMahon refrigerators has generally been controlled by mechanical devices such as cams. For example, in U.S. Pat. No. 3,188,821 to Fred F. Chellis, spool valves control the flow of working fluid to and from a working chamber and a displacer drive chamber. In one embodiment of that patent, cams associated with the spool valves are driven by a disc on a rod extending from the refrigerator displacer. In another embodiment, the spool valves are pneumatically controlled through ports associated with the displacer. In each case, the valve and displacer must be closely associated structurally and timing of the valves is not readily adjusted. In another embodiment disclosed in that patent, the spool valve is controlled by a solenoid which is independent of the displacer position.

Work extracting expansion engine refrigerators also include valves for controlling the flow of working fluid into and out of an expansion cylinder. The working fluid is first cooled in a heat exchanger and then valved into the cold end of the cylinder where it expands and drives a piston. The expanded and thus cooled gas is then directed back through the heat exchanger by another valve to cool the incoming working fluid. In the past, the valves have generally been controlled by cams mounted on a rotating crank shaft driven by the expansion piston. Also, piston responsive microswitches have been used to control the solenoid valve actuators, Johnson et al., "Hydraulically Operated Two-Phase Helium Expansion Engine," *Advances in Cryogenic Engineering,* Vol. 16, pp 171–77. In either case, there is little opportunity for adjustment of timing.

An object of this invention is to provide a means for controlling the timing of cryogenic refrigerators.

A further object of this invention is to provide timing control mechanisms which are readily adjustable and which may respond automatically to the operating characteristics of the system.

DISCLOSURE OF THE INVENTION

One or more parameters of a reciprocating-piston type refrigerator are monitored to provide an electrical feedback signal. That signal is processed to control the timing of the piston movement and/or the flow of refrigeration gas into the refrigerator. Preferably, the feedback signal is an indication of the position of the piston within its cylinder or the temperature at the cold end of the cylinder throughout a refrigeration cycle.

Continuous position indications may be provided by a linear variable displacement transformer or by a rotary encoder. Preferably, the feedback signal controls valves which introduce the refrigeration gas into the cylinder or a piston drive motor. In a pneumatically driven refrigerator the feedback signal may be used to control valves to and from both the refrigeration cylinder and the drive cylinder.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

BEST MODES OF CARRYING OUT THE INVENTION

Figure 1:
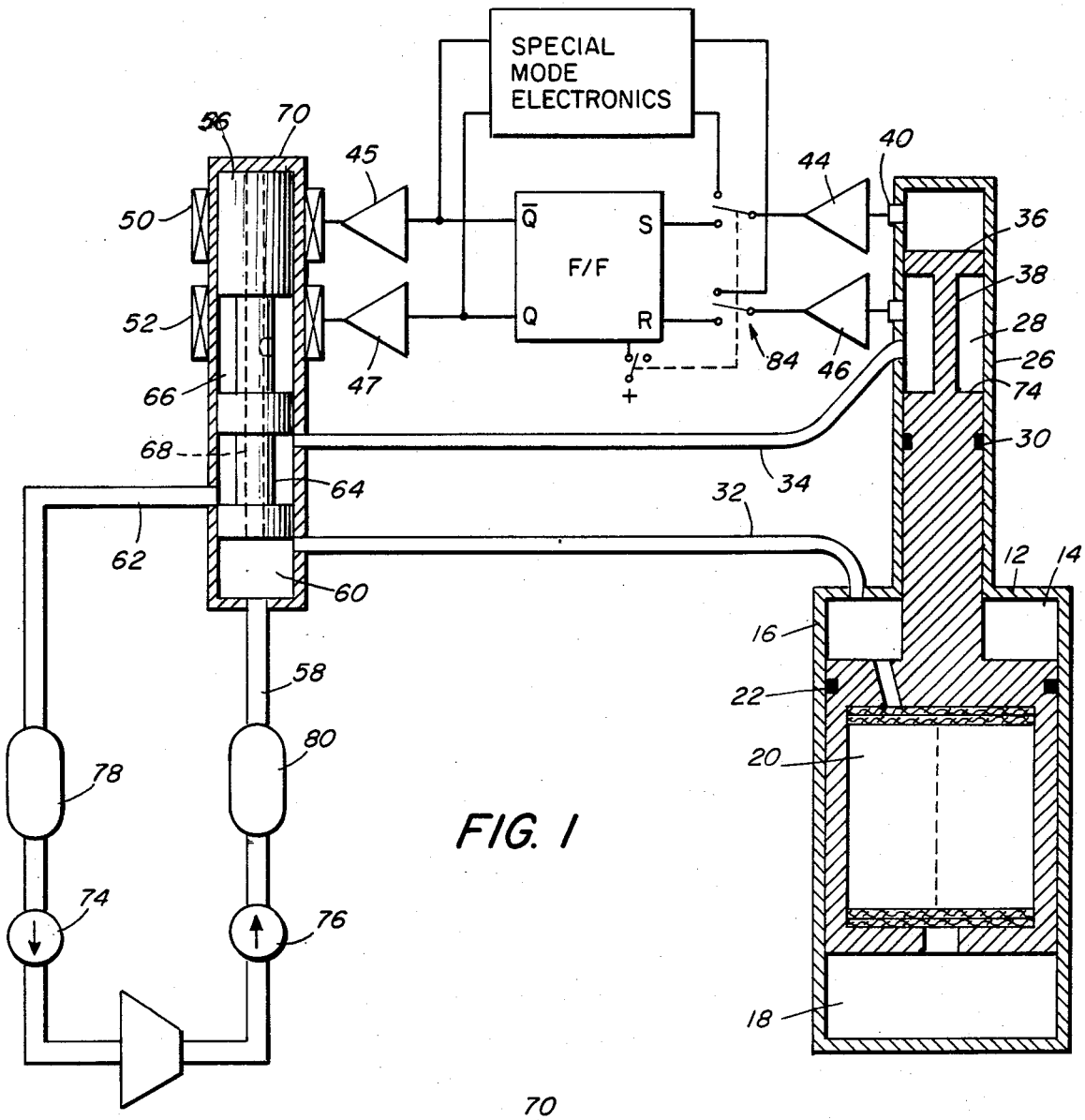
FIG. 1 is a schematic illustration of a Gifford-McMahon cryogenic refrigeration system embodying the present invention and in which working fluid flow to a gas-driven displacer is controlled by proximity sensors and a spool valve.

In the cryogenic refrigeration system of FIG. 1, a displacer 12 is positioned for reciprocal movement within a refrigeration cylinder 14. The displacer and cylinder define an upper warm chamber 16 and a lower cold expansion chamber 18. The two chambers are in fluid communication through a regenerative matrix 20 within the displacer 12. In this case the matrix is copper mesh but it may also be in the form of lead beads or any other suitable regenerative material. A seal 22 prevents fluid flow between the two chambers other than through the regenerative matrix.

For fluid drive of the displacer, a piston element 24 extends upwardly into a drive cylinder 26 having a lesser diameter than the cylinder 14. The drive piston 24 and cylinder 26 define a fluid drive chamber 28 separated from the warm chamber 16 by a seal 30.

In normal operation, while the displacer 12 is in its lowermost position, high pressure working fluid such as helium is introduced into the warm chamber 16 and the regenerative matrix 20 through a fluid line 32. At the same time, drive fluid in chamber 28 is exhausted through a fluid line 34. The resulting imbalance in fluid pressure on the piston element 24 drives the displacer 12 upwardly within the cylinder 14. With upward movement of the displacer 12, high pressure working fluid in the upper chamber 16 passes through the regenerative matrix 20 to the lower chamber 18. With that flow the working fluid gives off heat to the relatively cool regenerative matrix. As the fluid is cooled, the high pressure is maintained by continued supply of fluid through line 32.

As the displacer approaches its uppermost position, the working fluid is exhausted through fluid line 32 while high pressure drive fluid is applied to the chamber 28 through line 34. With high pressure gas being exhausted from the cylinder 14, the gas in the regenerative matrix and cold chamber 18 expands and is thus cooled. Also, the displacer is driven downwardly by the pressure imbalance across the piston element 24. During this downward movement, the expanded, cooled gas passes upwardly through the regenerative matrix to cool that matrix. Finally, as the displacer 12 approaches the lower end of the cylinder 14, the cycle begins again with high pressure gas applied through the line 32.

In accordance with the present invention, the position of the displacer 12 within refrigeration cylinder 14 is monitored to control the timing of high pressure and exhaust valving to and from the refrigerator. To that end, a position indicating disc 36 is mounted above the piston element 24 at the end of a rod 38. As the displacer approaches the upper extent of its recriprocating movement, the disc 36 is detected by a proximity sensing transducer element 40. The element 40 may be any suitable proximity sensor such as a capacitive, inductive, or photoelectric pickup. Similarly, a transducer element 42 sense the disc 36 as the displacer 12 approaches the lower limit of its movement.

During normal operation of the refrigerator, the signals from transducer elements 40 and 42 are applied through amplifiers 44 and 46 to the set and reset inputs of an R-S flip-flop. The Q and $\overline{Q}$ outputs of the flip-flop are applied through current drivers 45 and 47 to the coils 50 and 52 of a solenoid actuated valve 54. With the coil 50 energized, the solenoid slug 56 is drawn into its uppermost position, high pressure working fluid is applied from a high pressure line 58 through the lower valve chamber 60 to the fluid line 32. Also, the fluid line 34 is exhausted through an annular valve chamber 64 to a low pressure line 62.

Figure 2:
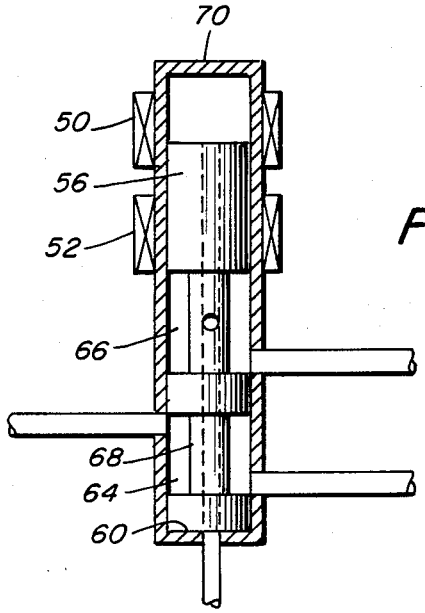
FIG. 2 shows the spool valve of FIG. 1 in a second control position.

When the coil 52 is energized, the slug 56 is moved downwardly to the position shown in FIG. 2. High pressure fluid is applied through a central bore 68 and an upper annular chamber 66 to the drive chamber line 34. Also, the line 32 is exhausted through the lower annular chamber 64 and low pressure line 62. To balance the fluid pressure applied to the valving element, the bore 68 extends upwardly to an upper valve chamber 70.

The high pressure working fluid is provided by a compressor 72 positioned between low and high pressure reservoirs 78 and 80 and check valves 74 and 76.

In operation, as the displacer approaches the uppermost extent of its upward movement, transducer element 40 detects the disc 36 and flip-flop 48 is set. A high signal is then applied from the Q output to coil 52 to move the valve element 69 to the position of FIG. 2. This causes working fluid to be exhausted from the cylinder 14 through line 32 to cause expansion and cooling of the fluid. Simultaneously high pressure drive fluid is introduced into chamber 28 through line 34 to drive the displacer downward.

When the downwardly moving displacer approaches its lowermost position, the disc 36 is detected by tranducer element 42 and the flip-flop 48 is reset. The resultant high signal on the $\overline{Q}$ output of the flip-flop energized coil 50 to move the valve element 69 into the position of FIG. 1. High pressure gas is introduced into the cylinder 14 and the drive fluid is exhausted. The high pressure working fluid then drives the displacer upwardly to continue the next cycle.

By properly positioning the proximity sensor transducer elements 40 and 42, the timing of the solenoid actuated valve 54 can be controlled to guarantee full stroking of the displacer 12 without rapping at the ends of the strokes. At times, however, maximum cooling is not required. In such situations, special mode electronics 82 can be connected to bypass the flip-flop 48 by throwing a switch 84. A timer in the electronics 82 may energize coil 52 before the disc 36 is detected by transducer element 40. The result is a shortened stroke and less cooling. Also, the special mode electronics may provide start-up signals to the valve 54 since the system is not otherwise selfstarting.

As an alternative to the flip-flop 48, a bistable solenoid may be used.

Figure 3:
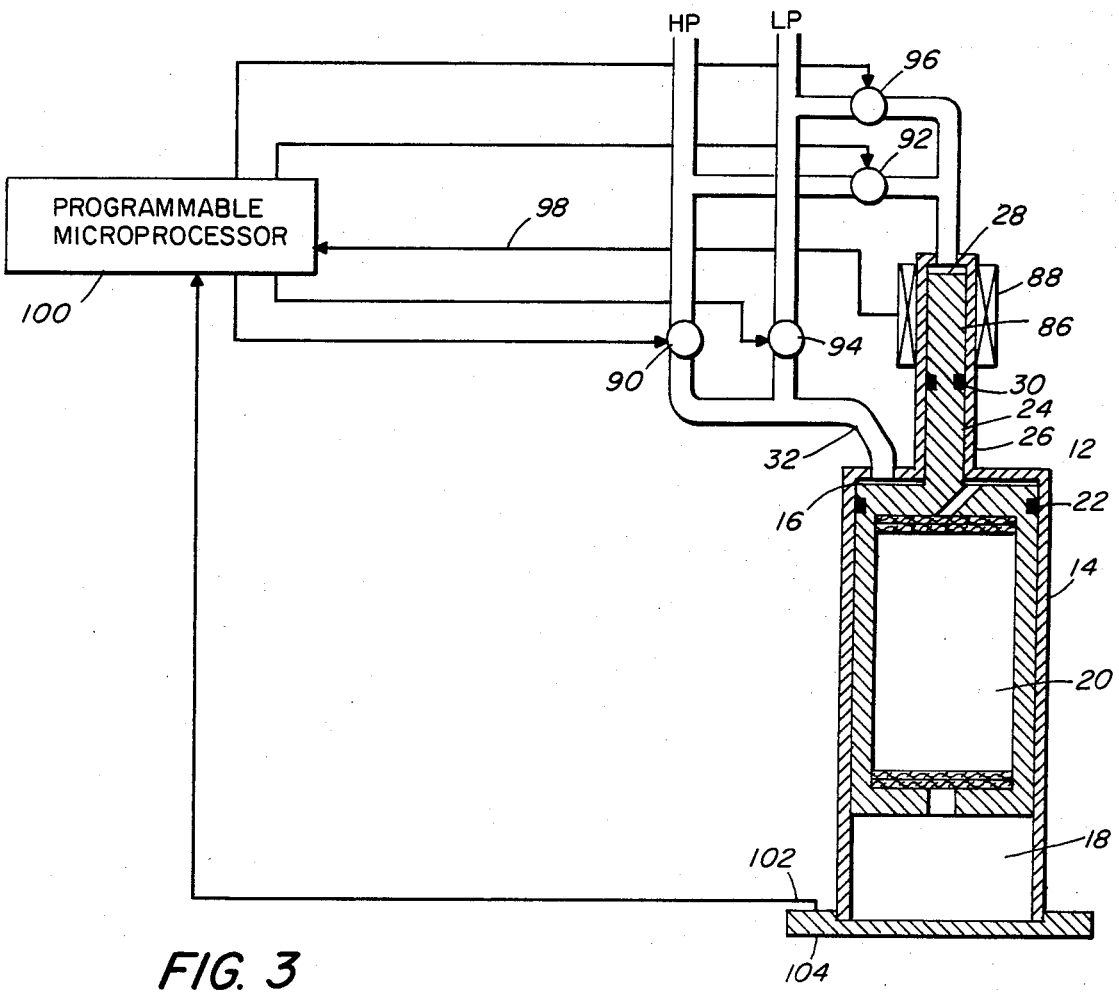
FIG. 3 shows an alternative embodiment of the invention in which the refrigerator valves are controlled by a programmable microprocessor which responds to a linear variable displacement transformer and a temperature sensor.

The embodiment of FIG. 3 provides even greater flexibility in the control of a cryogenic refrigerator having fluid drive of the displacer. In that system, a magnetically permeable slug 86 extends upwardly from the piston element 24. The upper portion of the drive cylinder 26 is surrounded by a coil 88. The slug 86 and coil 88 form a linear variable displacement transformer (LVDT). The length of the slug 86 is positioned within the coil 88 determines the inductance of the coil and that change in inductance provides an indication which is linearly proportional to the length of the slug 86 within the coil. By means of the LVDT, the position of the displacer 12 is monitored throughout its movement.

High pressure fluid is applied to the working chamber within cylinder 14 and to the drive chamber 28 by respective high pressure valves 90 and 92. Similarly, the fluid is exhausted from the working chamber and the drive chamber through respective low pressure valves 94 and 96.

The position signal from the linear variable displacement transformer 89 is applied to a programmable microprocessor 100 at input 98. The microprocessor then provides individual signals to the valves 90, 92, 94 and 96 in accordance with the actual position of the displacer 12 and a processor program. The microprocessor is readily programmable for various modes of operation.

A temperature sensor 102 is mounted to an end cap 104 on the cylinder 14. The sensor 12 provides an indication of the temperature at the cold end of the refrigerator as another input to the microprocessor 100 throughout the refrigeration cycle. Thus, the microprocessor may provide full stroke control for maximum cooling or shortened stroke control for cooling some predetermined temperature. The microprocessor can also be programmed to provide for special start-up operation.

Figure 4:
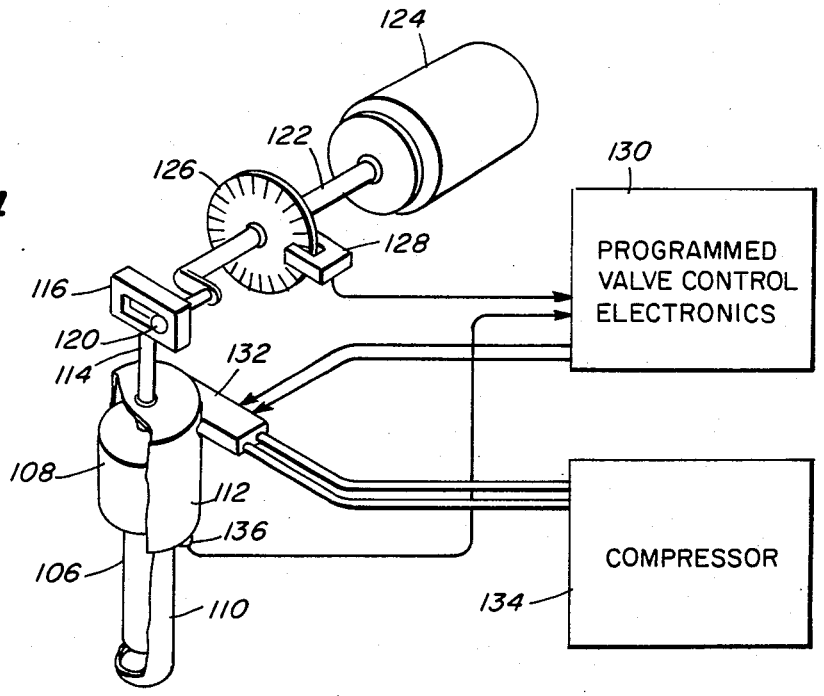
FIG. 4 shows yet another embodiment of the invention in which the displacer is driven by an electrical motor and the displacer position is determined from an encoder disc.

The embodiment of FIG. 4 is a two stage refrigerator in which the displacer elements are driven by an electric motor. Displacer elements 106 and 108 reciprocate together in cylinders 110 and 112. A drive rod 114 is fixed to the large displacer element 108 and is driven in a reciprocating movement by a scotch yoke 116. The scotch yoke 116 is driven by a bearing 120 which rotates with crank 118 on a motor drive shaft 122. The drive shaft 122 extends from the motor 124.

The exact position of the displacer during its strokes is monitored by means of a code disc 126. The code disc has a plurality of marks around its circumference which can be detected by a transducer element 128. The transducer 128 may for example, be a magnetic or photoelectric pickup. The transducer 128 sends a clocking signal to the programmed valve control electronics 130. The electronics are programmed to actuate the solenoid actuated valves 132 at predetermined positions of the displacer. Those valves supply high pressure working fluid from the compressor 134 to the cylinder 112 and exhaust the working fluid back to the low pressure side of the compressor. As in the embodiment of FIG. 3, a temperature sensor 136 provides an indication of operating temperature to the electronic control.

Figure 5:
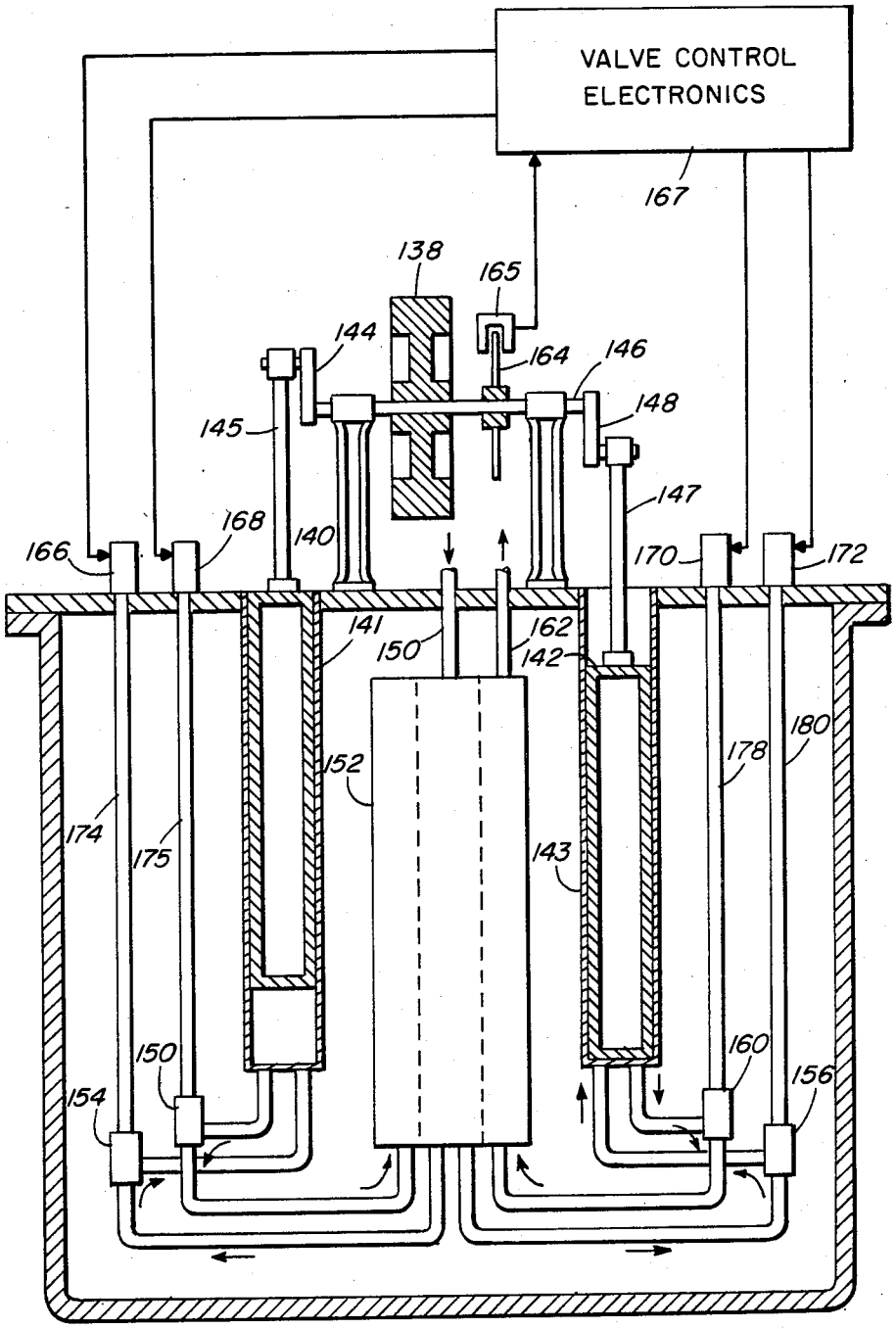
FIG. 5 is a further embodiment of the invention in which valve control electronics respond to an encoder disc at the output of the multicylinder expansion engine.

Yet another embodiment of the invention is shown in FIG. 5. In that embodiment, a two cylinder expansion engine drives an output wheel 138. The wheel 138 may, for example, be connected to a fluid brake to extract energy from the expansion engine.

The expansion engine includes two pistons 140 and 142 which reciprocate in cylinders 141 and 143. The respective pistons drive piston rods 145 and 146 which in turn drive cranks 144 and 148. The cranks are joined by crank shaft 146 and operate 180° out of phase. High pressure working fluid from line 150 is cooled in heat exchange 152 and alternately valved into the cold ends of the cylinders 141 and 143 by respective high pressure valve 154 and 156. While high pressure fluid expands in one cylinder, expanded fluid is vented from the other through a respective low pressure valve 158 or 160. The cold exhaust gas is returned through the heat exchanger 152 to cool the incoming high pressure working fluid.

In accordance with the present invention, a code disc 164 is mounted on the crank shaft 146. As in the prior embodiments, the code disc includes markings around its circumference which are detected by a transducer element 165. The transducer element 165 provides clocking signals to valve control electronics 164. These electronics in turn actuate solenoid actuated valve operators 166, 168, 170 and 172 in response to the positions of the pistons 140 and 142. These operators in turn control the valves at the cold end of the cylinders through operating rods 174, 176, 178 and 180. Alternatively, the solenoids may control the gas to and from gas actuated valves which in turn drive the operating rods.

Figure 6:
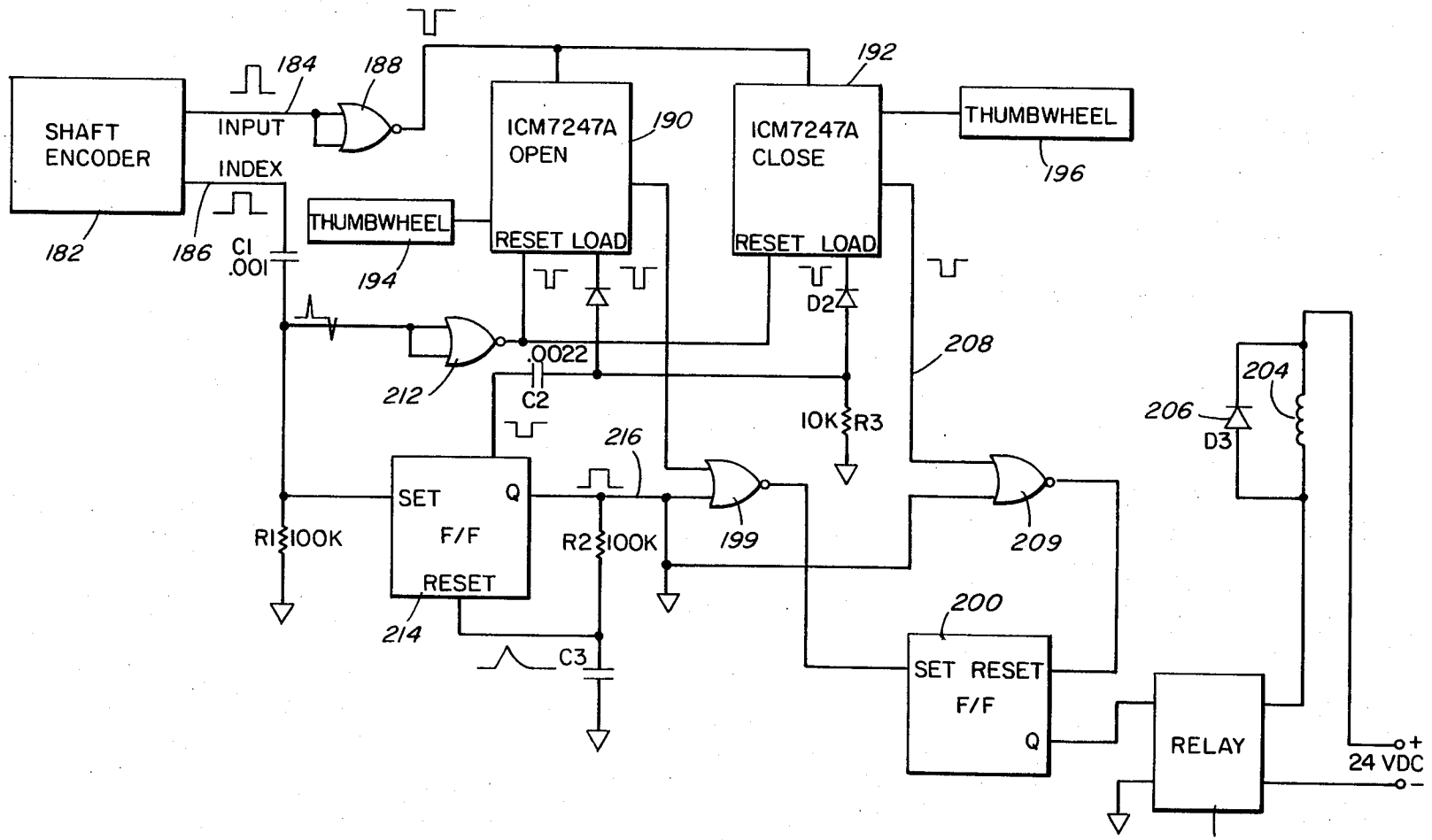
FIG. 6 is an electrical schematic of one form of encoder responsive control electronics such as used in either of FIGS. 4 and 5.

Detailed control circuitry for use as the valve control electronics 130 and 167 in respective FIGS. 4 and 5 is shown in FIG. 6. The control electronics receive two signals from a shaft encoder 182. The signal on line 184 is of 360 pulses per revolution of the drive shaft of the refrigerator. The signal on line 186 is an index signal of one pulse per revolution.

The pulses on line 184 are inverted by the NOR gate 188 and applied to counters 190 and 192. When the count in a counter matches that set by its thumb wheel 194 or 196, an output pulse is provided on line 198 or 208. The thumb wheel 194 is set to correspond to the shaft position at which a valve is to be opened. The thumb wheel 196 is set to a shaft position at which the same valve is to be closed. The valve opening signal on line 198 is passed through a NOR gate 199 to a flip-flop 200. With the flip-flop 200 thus set, its Q output goes high to close a relay 202. The relay 202 provides power to the coil 204 of a valve solenoid to open that valve. A reverse-current protection diode 206 is connected across that coil.

The control valve remains open until the shaft position indicated by thumb wheel 196 is reached. At that point, the counter 192 provides an output on line 208 which is passed through a NOR gate 209 to reset the flip-flop 200. The Q output thus goes low to open the relay 202 and release the normally closed valve.

The index signal on line 186 is processed to reset the counters 190 and 192, to load the positions indicated on thumb wheels 194 and 196 into the counters and to disable the signals to the flip-flop 200 during the load operation.

The index signal is applied through a differentiating capacitor 210 and an inverting NOR gate 212 to reset the count on each of the counters 190 and 192 to zero. Also, the differentiated signal is applied to a flip-flop 214 which responds with a low signal from its $\overline{Q}$ output through capacitor C2 and diodes D1 and D2. With that low signal applied to the counters, the reference values held on the thumb wheels 194 and 196 are loaded into the counter.

To disable the signals to the flip-flop 200 during reloading and thus block any spurious signals to that flip-flop, the flip-flop 214 has resistor R2 and capacitor C3 connected between its Q output and reset input. This RC feedback to the reset input causes the flip-flop 214 to act as a one shot timer. The flip-flop is reset only after a pulse longer in duration that that passed through the differentiating capacitor C1 has been provided on line 216. That pulse holds the outputs of the NOR gates 199 and 209 low.

Two counters such as 190 and 192 and a flip-flop 200 and relay 202 would be provided for each solenoid actuated valve.

Figure 7:
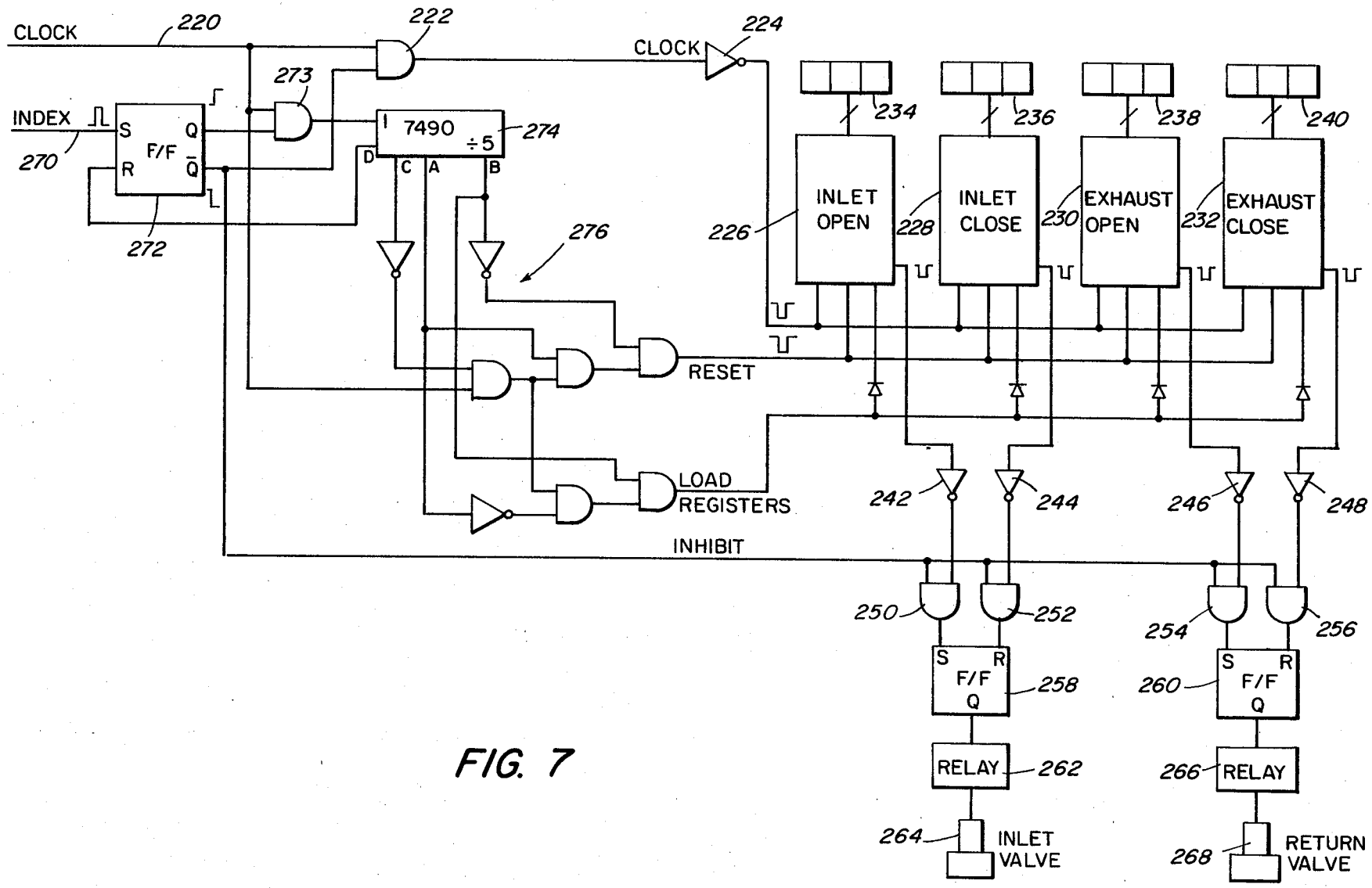
FIG. 7 is an electrical schematic of alternative control electronics.

Control electronics similar to that of FIG. 6 but shown connected to control two solenoid actuated valves and making use of digital logic to replace the index processing analog circuitry of FIG. 6 is shown in FIG. 7. The 360 pulse per revolution clock signal on line 220 is passed through an AND gate 222 and an inverter 224 to the input of four counters 226, 228, 230 and 232.

Figure 8:
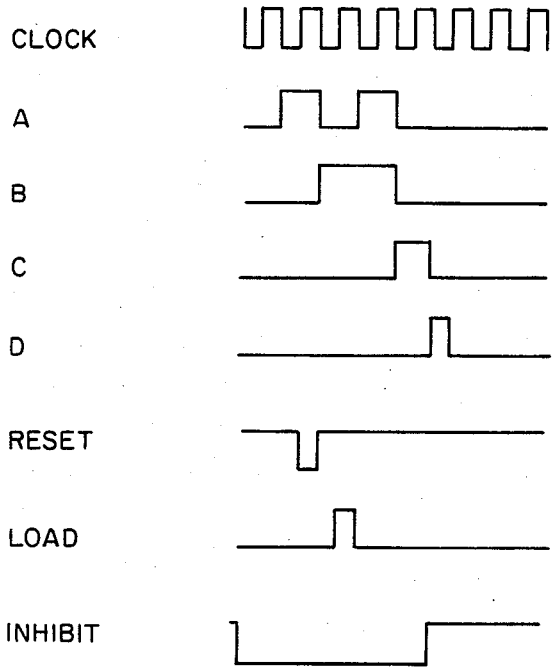
FIG. 8 is a timing chart for the circuit of FIG. 7.

Once the count of those pulses matches that set by the respective thumb wheel switches 234, 236, 238 and 240, each counter outputs a pulse through respective inverters 242, 244, 246 and 248. As in the circuit of FIG. 6, those signals are passed through gates 250, 252, 254 and 256 to the two flip-flops 250 and 260. Setting of the flip-flop 258 by the pulse output from counter 226 causes the Q output of that flip-flop to go high to close the relay 262 and thus open the inlet valve 264. A pulse from counter 228 applied to the reset input of flip-flop 258 returns the Q output low to open the relay 262 and thus close the valve 264. Similarly, the outputs from counters 230 and 232 close and open the relay 266 to open and close the return or exhaust valve 268. A timing chart for selected signals in the index processing circuitry is provided in FIG. 8. The index on line 270 occurs once per revolution of the shaft encoder. It sets the flip-flop 272, and the Q output from the flip-flop then enables the clock input through an AND gate 273 to a divide by five counter 274. After the index signal is received on line 270, the fifth clock pulse on line 220 causes a pulse on line D from the counter 274 to reset the flip-flop 272. This ends a five pulse reset, load, disable time period. During that five pulse time period, the low $\overline{Q}$ output from flip-flop 272 holds the output of AND gate 222 low to prevent clocking of the counters 226, 228, 230 and 232. Also, that low output holds the outputs of AND gates 250, 252, 254 and 256 low to prevent any spurious setting or resetting of flip-flops 258 and 260 during the reload period. During the disable time period, the signals A, B and C shown in FIG. 8 are applied through inverter/AND logic circuitry 276 to provide the reset and load signals shown in FIG. 8. These signals are applied to the respective counters to reset them to a zero count and to load the reference values from the thumb wheel switches.

Figure 9:
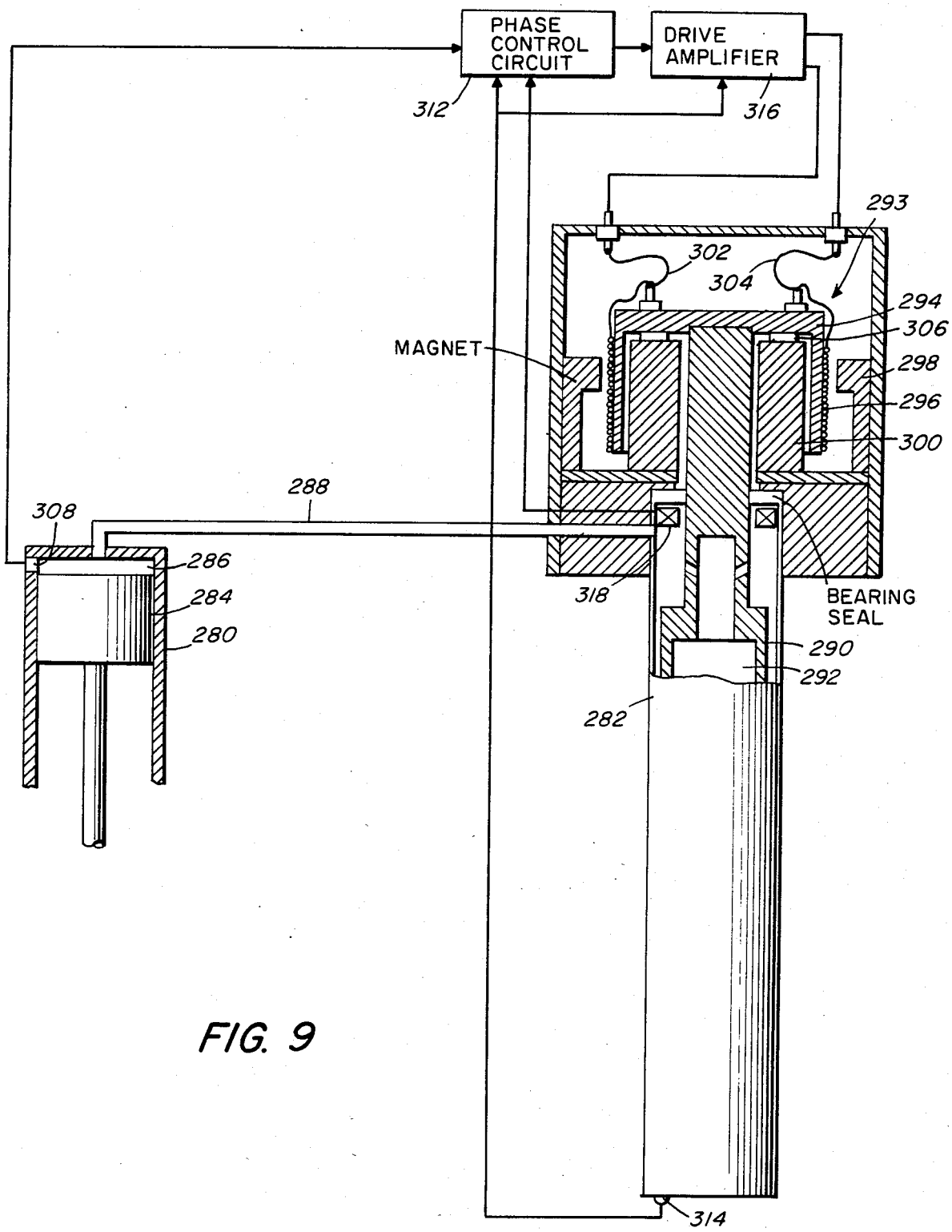
FIG. 9 shows yet another embodiment of the invention in which a temperature feedback signal controls a linear, displacer-drive motor.

Another embodiment of the invention is shown in FIG. 9. In this refrigeration system, there are no valves between the compressor 280 and the refrigerator cylinder 282. Rather, the refrigeration gas is held in a closed volume the pressure of which is varied sinusoidally by reciprocating movement of the compressor piston 284. The pressure wave in the heat volume 286 of the compressor is transmitted through a line 288 to the volume within the refrigeration cylinder 282. A displacer 290 having a regenerative matrix 292 reciprocates within the cylinder 282. The displacer 290 is driven by a linear motor 293. The motor includes an inverted cup 294 which supports a coil 296. One leg 298 of an annular magnet surrounds the coil 296 and an inner leg 300 extends within the coil. With controlled driving of the coil 296 through flexible leads 302 and 304, the cup 294 and the attached displacer 290 are driven in a reciprocating movement. Pads 306 stop the cup 294 at its lowermost position.

To control the drive of the linear motor 293, the pressure wave is monitored throughout the refrigerator cycle by a pressure transducer 308. That signal is applied as one input to a phase control circuit 312. In addition, the temperature at the cold end of the refrigeration cylinder 282 is monitored by a resistive temperature sensor 314. The temperature signal is applied as another input to the phase control circuit 312. That phase control circuit controls the timing of the movement of the displacer 290 in any preprogrammed fashion. The phase control signal is applied to a drive amplifier 316 along with the temperature signal to finally drive the coil 296. A displacer position signal may also be fed back to the control circuitry from a transducer 318.

The circuit 312 provides phase correction of the pressure wave signal for proper stroking relationship, including length of stroke, of the displacer with respect to the pressure wave. The temperature feedback adjusts various parameters of the control loop for automatic control of the cold temperature.

A further advantage of any of the embodiments described above can be found where the refrigerator is used to cool an electronic device such as a Josephson junction. A Josephson junction device is extremely sensitive to the mechnical vibration of a cryocooler. This problem can be solved by multiplexing the cooler operation with the operation of the Josephson junction electronics. Those electronics are activated only during dwells in the cryocooler operating cycle. They are deactivated during parts of the cryocooler cycle when the mechanical drive is active. The conventional cryocooler cycle is modified to provide that dwell at the top dead center and bottom dead center positions.

While the invention has been particularly shown and described with reference to preferred embodiments thereof, it will be understood by those skilled in the art that various changes in form and details may be made therein without departing from the spirit and scope of the appended claims.

We claim:

1. A cryogenic refrigerator having a displacer reciprocating in a refrigeration cylinder for displacing refrigeration gas through a regenerator and for expanding and thus cooling the refrigeration gas and gas control valve means for admitting high pressure gas into the refrigeration cylinder and for exhausting the gas from the refrigeration cylinder, the refrigerator comprising:

means responsive to a physical parameter of the refrigerator for providing an electrical indication of that physical parameter; and electrically operated timing control means responsive to said electrical indication for controlling the relative timing of the displacer movement and operation of the gas control valve means.

2. A cryogenic refrigerator as claimed in claim 1 further comprising an electrical motor for driving the displacer in its reciprocating movement.

3. A cryogenic refrigerator as claimed in claim 2 wherein the timing control means controls the gas control valve means for admitting high pressure gas into the refrigeration cylinder and for exhausting the gas from the refrigeration cylinder.

4. A cryogenic refrigerator as claimed in claim 3 wherein the means responsive to a physical parameter is responsive to the position of the displacer.

5. A cryogenic refrigerator as claimed in claim 4 wherein the means responsive to the physical parameter is a linear variable displacement transducer.

6. A cryogenic refrigerator as claimed in claim 4 wherein the electrical motor is a rotary motor and the means responsive to a physical parameter is a rotary optical encoder.

7. A cryogenic refrigerator as claimed in claim 4 further comprising means responsive to temperature of the refrigerator and wherein said electrically operated timing control means is responsive to that temperature.

8. A cryogenic refrigerator as claimed in claim 3 wherein the means responsive to a physical parameter is reponsive to temperature of the refrigerator.

9. A cryogenic refrigerator as claimed in claim 1 further comprising a pneumatic drive volume for driving the displacer in its reciprocating movement, wherein the electrically operated timing control means controls first gas control valve means for admitting high pressure gas into the refrigeration cylinder and for exhausting the gas from the cylinder and a second gas control valve means for admitting high pressure gas into the drive volume and for exhausting the gas from the drive volume.

10. A cryogenic refrigerator as claimed in claim 9 wherein the means responsive to a physical parameter is a linear variable displacement transducer.

11. A cryogenic refrigerator as claimed in claim 10 further comprising means responsive to a temperature of the refrigerator and wherein the electrically operated timing control means is responsive to said temperature.

12. A cryogenic refrigerator as claimed in claim 9 wherein the means responsive to a physical parameter of the refrigerator is responsive to temperature of the refrigerator.

13. A cryogenic refrigerator as claimed in claim 1 wherein the timing control means controls the drive of the piston.

14. A cryogenic refrigerator as claimed in claim 13 further comprising a pneumatic drive volume for pneumatically driving the displacer and wherein the timing control means controls gas control valve means for admitting high pressure gas into the drive volume and for exhausting the gas from the drive volume.

15. A cryogenic refrigerator as claimed in claim 14 wherein the means responsive to a physical parameter is responsive to the position of the displacer.

16. A cryogenic refrigerator as claimed in claim 15 wherein the means responsive to a physical parameter is a linear variable displacement transducer.

17. A cryogenic refrigerator as claimed in claim 15 further comprising means responsive to temperature of the refrigerator.

18. A cryogenic refrigerator as claimed in claim 14 wherein the means responsive to a physical parameter is responsive to temperature of the refrigerator.

19. A cryogenic refrigerator as claimed in claim 1 wherein the timing control means comprises a programmable electronic processor.

20. A cryogenic refrigerator as claimed in claim 1 wherein the timing control means synchronizes drive of the displacer with operation of an electronic device cooled by the cryogenic refrigerator such that the displacer is not moved during operation of the electronic device.

21. A system comprising a cryogenic refrigerator having a displacer reciprocating in a refrigeration cylinder for expanding and thus cooling a refrigeration gas which flows into and out of the refrigeration cylinder, the system comprising:

an electronic device cooled by the cryogenic refrigerator; and electrical timing control means for synchronizing the movement of the displacer and operation of the electronic device so that the electronic device is not operated while the displacer is moving.

* * * * *